US008203573B1

(12) United States Patent
Schwarzer

(10) Patent No.: US 8,203,573 B1
(45) Date of Patent: Jun. 19, 2012

(54) SYSTEMS AND METHODS FOR ASSEMBLING IMAGE DATA FOR TRANSMISSION ACROSS A DIGITAL VIDEO INTERFACE

(75) Inventor: Martin Schwarzer, Wuerselen (DE)

(73) Assignee: NVIDIA Corporation, Santa Clara, CA (US)

( * ) Notice: Subject to any disclaimer, the term of this patent is extended or adjusted under 35 U.S.C. 154(b) by 1218 days.

(21) Appl. No.: 11/958,304

(22) Filed: Dec. 17, 2007

(51) Int. Cl.
*G09G 5/02* (2006.01)

(52) U.S. Cl. ..... 345/605; 345/600

(58) Field of Classification Search ..... None
See application file for complete search history.

(56) References Cited

U.S. PATENT DOCUMENTS 5,325,126 A * 6/1994 Keith ..... 375/240.12
2002/0171761 A1* 11/2002 Suzuki et al. ..... 348/484
2002/0181608 A1* 12/2002 Kim et al. ..... 375/295
2004/0062305 A1* 4/2004 Dambrackas ..... 375/240.01
2006/0053441 A1* 3/2006 Walker ..... 725/30
2006/0227064 A1* 10/2006 Tamano et al. ..... 345/3.1
2007/0076123 A1* 4/2007 Ogilvie ..... 348/571

OTHER PUBLICATIONS

Digital Display Working Group, "Digital Visual Interface DVI Revision 1.0," Apr. 2, 1999.

* cited by examiner

*Primary Examiner* — Donald Mills
(74) *Attorney, Agent, or Firm* — Zilka-Kotab, PC

(57) ABSTRACT

A method for assembling image data for transport across a digital video interface includes receiving and converting first-formatted pixel data to a second-formatted pixel data. The second-formatted pixel data is readable by a rendering device, the second-formatted pixel data having a bit width that differs from an input bit width standard of the digital video interface. The second-formatted pixel data is assembled into a transport packet having a bit width which is equal to the input bit width standard of the digital video interface. The digital video interface is operable to receive the transport packet comprising the second-formatted pixel data, and thereby communicate the second-formatted pixel data to the rendering device.

21 Claims, 3 Drawing Sheets

SYSTEMS AND METHODS FOR ASSEMBLING IMAGE DATA FOR TRANSMISSION ACROSS A DIGITAL VIDEO INTERFACE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates to systems and methods for processing image data, and more particularly, to systems and methods for assembling data for transmission across a digital video interface.

BACKGROUND OF THE INVENTION

High resolution graphics are used in a variety of applications, for example in medical imagining, computer workstations, HDTV, game consoles and systems, computer-aided-design systems, and the like. High resolution imaging systems typically employ a graphics subsystem to produce images and a rendering device, such as a high resolution monitor, to display the GPU-generated images. The interconnection between the graphics subsystem and the rendering device plays an important role in the performance of the graphics system, as the interconnection must be able to communicate the graphics data at a sufficient rate (i.e., have a sufficient operating bandwidth) in order for the GPU-generated graphics to be rendered in the highest possible resolution on the monitor.

The Digital Visual Interface Specification, Revision 1.0 (referred to herein as the DVI standard, herein incorporated by reference), published by the Digital Display Working Group (DDWG) represents one standard for interconnecting a graphics subsystem to a DVI-compliant monitor. The DVI standard is configurable in either a single-link mode or a dual-link mode, each of which includes a plurality of bit stream paths (data channels) that are synchronized to a clock signal (bit clock). Each data channel is operable to receive an 8-bit pixel data of one of red, green or blue color components, the DVI operable to accept a 24-bit wide RGB pixel packet.

A graphics system employing a DVI link between the graphics subsystem and a monitor will perform optimally when the monitor is DVI-compliant. However, it may be desirable to provide high resolution graphics to a monitor which is not DVI-compliant, e.g., a monitor which is operable to read high resolution pixel data, albeit in a format which is not compliant with the DVI pixel format, i.e., a pixel format which is not 8-bit RGB, for example. Furthermore, use of the pre-existing DVI link architecture to provide an interconnection between the graphics subsystem and the non-compliant DVI monitor would be advantageous to avoid re-design of the interconnect system.

Accordingly, systems and methods are needed for communicating image data across a DVI link to a non-compliant DVI monitor.

SUMMARY OF THE INVENTION

The invention, in one embodiment, provides a method for assembling image data for transport across a digital video interface. The method includes receiving pixel data having a first format, and converting the pixel data into a second format. The second-formatted pixel data is readable by a rendering device, the second-formatted pixel data having a bit width that differs from an input bit width standard of the digital video interface. The second-formatted pixel data is assembled into a transport packet having a bit width which is compliant with the input bit width standard of the digital video interface. The digital video interface is operable to receive the bit-width compliant transport packet that includes the second-formatted pixel data therein, and communicates the second-formatted pixel data to the rendering device.

These and other features of the invention will be better understood in view of the following drawings and detailed description of exemplary embodiments of the invention.

For clarity, previously described features retain their reference indicia in subsequent drawings.

DETAILED DESCRIPTION OF EXEMPLARY EMBODIMENTS

Figure 1:
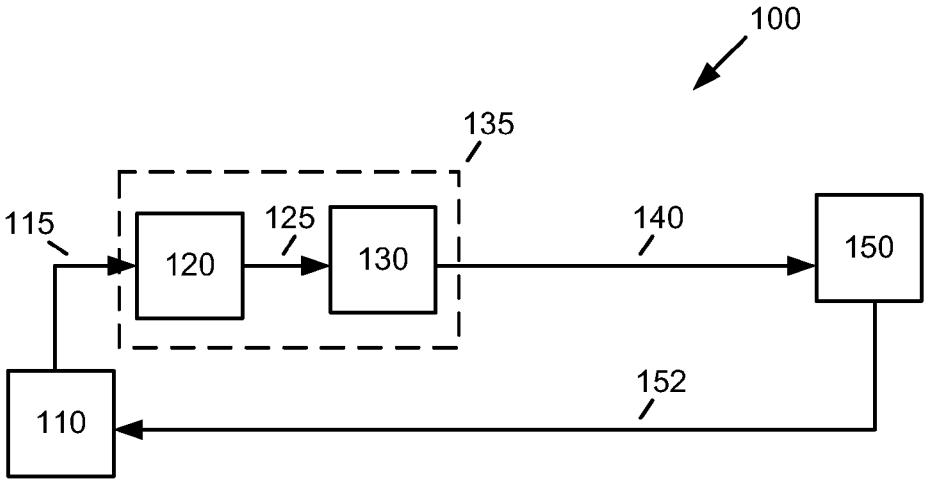
FIG. 1 illustrates a graphics display system in accordance with one embodiment of the present invention.

FIG. 1 illustrates a graphics display system 100 in accordance with one embodiment of the present invention. The system 100 includes a data source 110, a conversion shader module 120, a memory 130, a digital video interface (DVI) link 140 and an image rendering device 150. In a particular embodiment, the conversion shader module 120 and the memory 130 are included within a graphics subsystem 135, further described below.

The data source 110 is operable to provide pixel data 115 in any particular color space or format. The data source 110 may be any source operable to provide image data, for example a computer desktop which provides a stream of pixel data 115. In another exemplary embodiment, the data source 110 may be a medical imaging apparatus, such as an x-ray tomography system, magnetic resonance imaging (MRI) system, positron emission tomography (PET) system, or similar medical imaging systems which produces pixel data 115. Further exemplary, the data source 110 may be a data scanning system or an image tank.

The pixel data 115 may include color elements in accordance with any color model (e.g., RGB, grayscale, CYMK, YUV, YCbCr, etc.) and be of any fixed or floating point bit length. In a particular embodiment, the supplied pixel data 115 is in an 8-bit RGB format, although another color space, or color depth may be used as well. The 8-bit RGB format may be referred to as a "DVI compliant" format, as the total number of bits complies with an input bit width standard often used for DVI links, namely the single-link mode DVI which accepts a 24-bit input bit width packet. The above examples are exemplary, and those skilled in the art will appreciate that as the DVI standard is modified, the aforementioned definition of "DVI compliant" format will also vary.

The system 100 further includes a conversion shader module 120 which is operable to receive the stream of pixel data 115, and to convert pixel data 115 from a first format to a second format. Further particularly, the second format is a format which is readable by the rendering device 150. For example, the rendering device (e.g., an LCD monitor) 150 may be configured to read 12-bit grayscale pixel data. In such an instance, the conversion shader module 120 is operable to convert the stream of pixel data 115 (e.g., 8-bit RGB data packets) into 12-bit grayscale data. In general, the first and second pixel formats will differ in either (i) their respective color spaces (e.g., RGB versus grayscale), and/or (ii) their respective bit width (e.g., 8-bit RGB versus 16-bit RGB). The skilled person will appreciate that other format conversions are possible as well, e.g., converting RGB data into YUV data which is readable by a YUV compliant printer.

The conversion shader module 120 is further operable to assemble the second-formatted pixel data into a transport data packet 125 having a bit width which is in compliance with (e.g., equal to) the input bit width standard of the digital video interface 140. Continuing with the aforementioned exemplary embodiment, pixel data 115 supplied by the data source 110 is in an 8-bit RGB data format, which the conversion shader module 120 operates to convert into a 12-bit grayscale data format, the 12-bit grayscale format recognizable by the rendering device (e.g., an LCD monitor) 150. Further particularly, the input bit width standard of the digital video interface (single link mode) is 24-bits. Under such conditions, the conversion shader module 120 operates to combine two instances of such 12-bit grayscale data to form one 24-bit data packet for transmission to the DVI link 140 for transmission to the rendering device 150.

It will be appreciated that other permutations of this process can be implemented as well. For example, if the rendering device 150 is operable to read 6-bit grayscale data, and the DVI standard defines a 24-bit input packet width (e.g., when the DVI operates in a dual link mode), the conversion shader module 120 may operate to convert the 8-bit RGB pixel data 115 into 6-bit grayscale data, four instances/data words of which are combined into one 24-bit data packet for input to the DVI link 140. In this embodiment, the 6-bit grayscale data format is recognizable by the rendering device 150 and the 24-bit data packet is compliant with a standard governing the data packet width transmitted to the DVI link 140. Further alternatively, "filler" bits can be appended to the second-formatted pixel data (or to two or more combined instances of the second-formatted pixel data) to achieve a transport packet having the appropriate bit width, the filler bits disregarded by the rendering device 150.

In a further particular embodiment, the connection between the data source 110 (e.g., a desktop) and the conversion shader module 120 excludes an intervening program interface. Because the connection excludes an intervening program interface, a data source application (e.g., a desktop application) can be executed and the output seen on the rendering device 150 (e.g., a monitor) in real time. In another embodiment, the data source 110 is directly connected (without any intervening structures or processes) to the conversion shader module 120, this direct connection providing the aforementioned benefit of allowing an application to run on the data source (e.g. a desktop) and the output seen on the rendering device 150 in real time.

The conversion shader module 120 may be realized in software or firmware using any of a variety of different programming languages, such as OpenGL shading language (GLSL), High Level shader language (HLSL), Cg shader language, or other programming languages. Alternatively, the conversion shader module 120 may be implemented in hardware, e.g., in an Application Specific Integrated Circuit (ASIC), or similarly configured hardware circuitry.

Further exemplary, the conversion shader module 120 may be accessible by application programs via an application program interface (API), such as OpenGL®, D3D®, and DirectDraw®. Access to the conversion shader module 120 may be desired, for example, to load a new conversion shader module operable for converting pixel data (e.g., 8-bit RGB pixel data) into another type of formatted pixel data (e.g., 8-bit grayscale pixel data) which is readable by another type of rendering device 150. The new conversion shader module will be further operable to assemble the converted pixel data into the required packet bit width for transmission to the DVI link 140 (e.g., assembling three 8-bit grayscale pixel data assembled in a 24-bit data packet required by the DVI standard). As will be appreciated by the skilled person, the conversion shader module 120 may be implemented as a separate shader module, or incorporated within a unified shader module which incorporates pixel, vertex, and geometric shader operations. In a specific embodiment, the conversion shader module 120 is pre-compiled and added hardcoded into a driver package which is embedded into a dynamically linked library (dll).

The exemplary system 100 further includes a memory 130 coupled to receive and store the assembled transport packets 125 produced by the conversion shader module 120. In a particular embodiment, the memory 130 is a frame buffer operable to temporarily store a predefined frame of transport packets 125, the frame buffer operable to subsequently read out the transport packets 125 to the DVI link 140 at a predefined rate. In one embodiment, the frame buffer includes hardware and/or microcode to accelerate 2D or 3D graphics, although a non-accelerated frame buffer may be implemented in an alternative embodiment. The memory 130 may be of any particular size e.g., 1 Mb, 2 Mb, 4 Mb, 8 Mb, 16 Mb, 32 Mb, 64 Mb, 128 Mb or larger in order to support the desired resolution and color depth of the rendering device. Of course, frame buffers of other sizes may be used to provide the rendering device 140 with the desired resolution and color depth.

The exemplary system 100 further includes a digital video interface (DVI) link 140 to which the transport packets 125 are supplied. The DVI link 140 may be a cable which includes TMDS transmit and receive module(s) for transferring the second-formatted pixel data thereacross. Specific details of the DVI link 140 are described in the aforementioned publication "The Digital Visual Interface Specification, Revision 1.0 (DVI 1.0)" (herein "DVI Standard"), the contents of which is herein incorporated by reference. In particular, the DVI standard defines an input bit width of 24-bits. In accordance with this embodiment, the conversion shader module 120 is operable to assemble the second-formatted pixel data into a 24-bit wide transport packet for transmission to the DVI link 140. In a particular embodiment, the second-formatted pixel packet will have a bit width of other than 24-bits; i.e., the conversion shader module 120 will operate to convert the second-formatted pixel data into one of these formats, or from a bit width which is not compliant with the input bit width standard of the DVI link 140 to a bit width which is compliant to the input bit width standard of the DVI link 140.

The exemplary system 100 further includes a rendering device 150, embodiments of which include a monitor, a printer, or other similar output devices. In one embodiment, the rendering device 150 is operable to read pixel data in a format which is different from that output from the data source 110. For example, the data source 110 may be operable to supply pixel data in a 16-bit RGB format, while the rendering device is operable to read data in an 8-bit RGB format. Alternatively, the data source may be operable to output data in an 8-bit RGB format while the rendering device is operable to read data in a 12-bit grayscale format.

Further exemplary, the rendering device 150 may be operable, via a backchannel 152, to communicate with the conversion shader module 120 as to the pixel format (i.e. color space and/or color depth, e.g., 12-bit grayscale) which the rendering device 150 is operable to read. In such an embodiment, the conversion shader module 120 may be further configured to read such signals, and in response call up and execute an appropriate conversion shader protocol to convert the pixel data stream 115 to the format identified by the rendering device 150.

Figure 2:
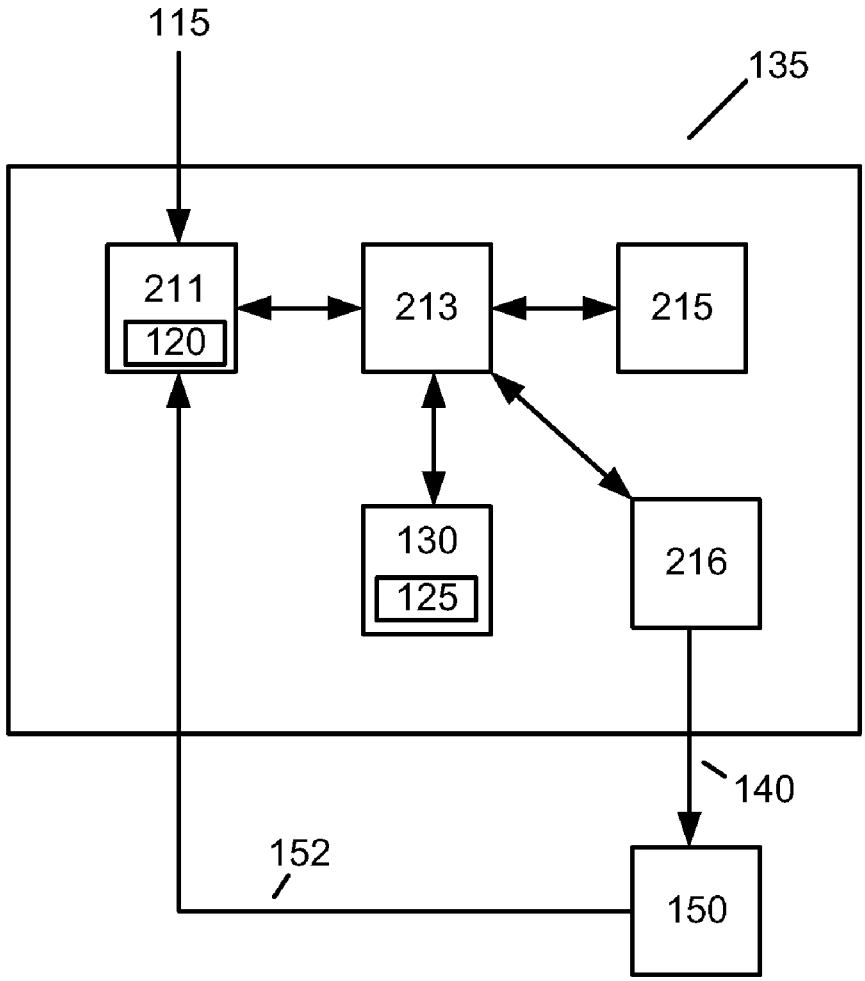
FIG. 2 illustrates a simplified block diagram of the graphics subsystem shown in FIG. 1 in accordance with the present invention.

FIG. 2 illustrates a simplified block diagram of the graphics subsystem of FIG. 1 in accordance with the present invention. The graphics subsystem 135 includes a processor 211, a memory 130 and memory interface 213, a scan out processor 214, and optionally a two-dimensional (2D) processor 215. The scan out processor 214 is coupled to the rendering device 150 via the DVI link 140.

In operation, pixel data 115 is received from the data source 110, such as a computer. Pixel data 115 is supplied to processor 211, which includes the aforementioned conversion shader module 120 for performing the aforementioned conversion shader operations. In particular, the conversion shader module 120 operates to convert the pixel data 115 from a first format to a second format, and assemble one or more instances of the second-formatted pixel data into a transport packet suitable for transmission to the DVI link 140 in accordance with the DVI's input bit width standard. The assembled transport packets 125 are subsequently written to memory 130 via the memory interface 213. Processor 211 may additionally provide geometry, pixel, texture, and raster operations normally performed by a graphics processing unit (GPU). Alternatively, these functions may be handled by one or more dedicated processors which can execute a gpu shader. In a particular embodiment of the invention, the connection between the data source 110 and the conversion shader module 120 excludes an intervening program interface. Such a connection enables one or more applications running on the data source 110 to be output on the rendering device (e.g. a monitor) in real time. In another embodiment, the data source 110 is directly connected (without any intervening structures or processes) to the conversion shader module 120, this direct connection providing the aforementioned benefit of allowing an application to run on the data source (e.g. a desktop) and the output seen on the rendering device 150 in real time.

The graphics subsystem 135 may include additional features, for example, the transmit modules which form a part of the DVI link 140. One of the transmit modules may be employed when the DVI 140 operates in a single-link mode, and two transmit modules may be used when the DVI 140 operates in a dual-link mode in accordance with the DVI standard. Complementary receive modules may be located within the DVI link 140, the rendering device 150, or a device/structure interposed between the DVI link 140 and the rendering device 150.

The graphics subsystem 135 may take a variety of forms, for example, that of an integrated circuit (IC) on a dedicated graphics card. In another embodiment, the graphics subsystem 135 resides within a system (e.g., a computer) generating the pixel data 115.

Figure 3:
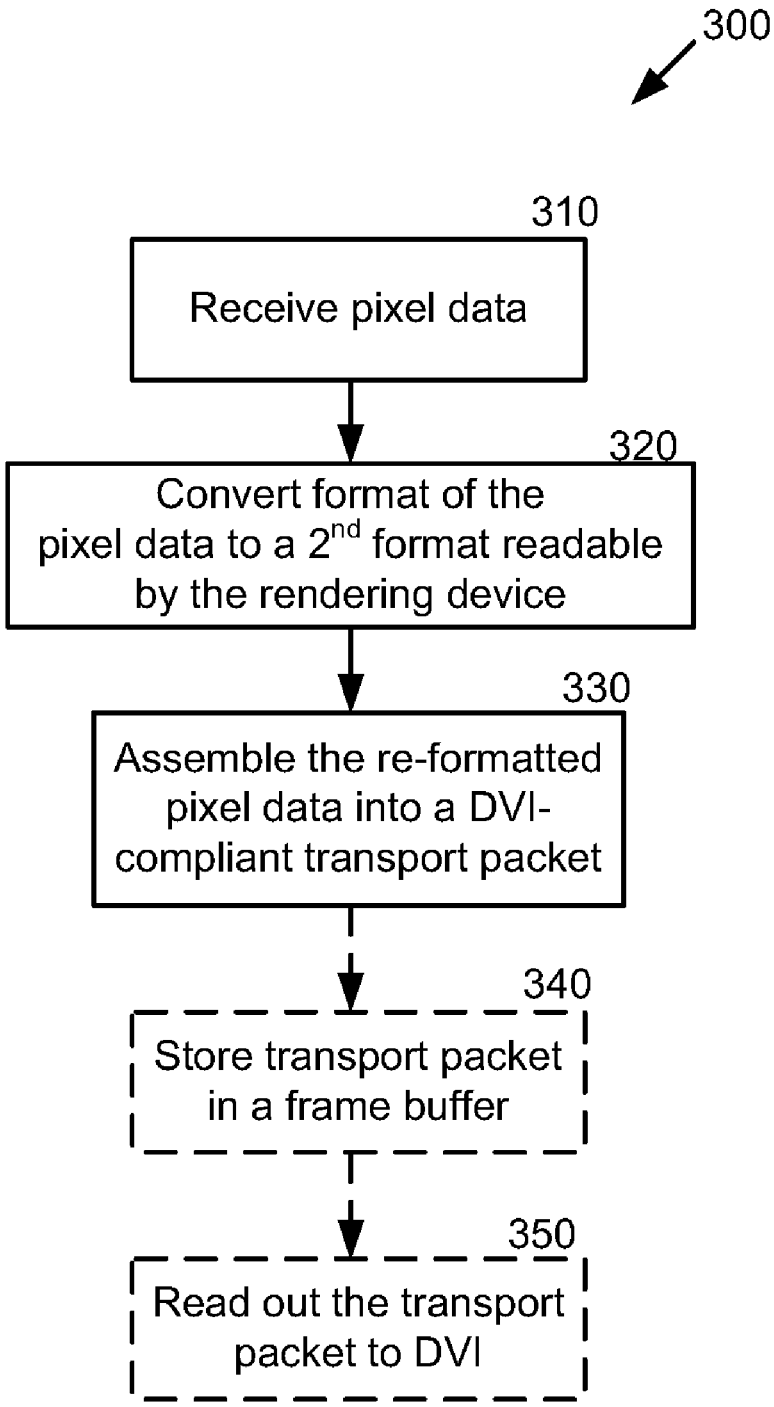
FIG. 3 illustrates a method for assembling format non-compliant DVI data for transport across a digital video interface in accordance with the present invention.

FIG. 3 illustrates an exemplary method 300 for assembling image data for transport across a digital video interface in accordance with one embodiment of the present invention. At 310, a stream of pixel data having a first pixel format is received. The pixel data 115 can be received from a variety of different data sources, including a computer desktop, a medical imaging apparatus, a data scanning system, an image tank, or other similar devices. Furthermore, the pixel data can be of any color space and/or bit length. In a particular embodiment of the invention, operation 310 includes communicating pixel data 115 from a data source 110 to a conversion shader module 120 without traversing an intervening program interface. As noted above, providing a connection between the data source 110 and the conversion shader module 120 which excludes an intervening program interface enables the execution of one or more applications on the data source 110 and their corresponding outputs on the rendering device (e.g. a monitor) in real time. In another embodiment, the data source 110 is directly connected (without any intervening structures or processes) to the conversion shader module 120, this direct connection providing the aforementioned benefit of allowing an application to run on the data source (e.g. a desktop) and the output seen on the rendering device 150 in real time.

At 320, the pixel data is converted from a first format to a second format readable by the rendering device. In an exemplary embodiment, this operation is performed by the conversion shader module 120 in accordance with the following instruction set, in which 8-bit RGB pixel data is converted into 12-bit grayscale pixel data:

```
TEX R0, 0x0, 0x0, 0x1, RGBX, 0x0;
I2F.F32.U32.ROUND.BEXT R0, R0;      # convert R to float
I2F.F32.U32.ROUND.BEXT R1, R1;      # convert G to float
I2F.F32.U32.ROUND.BEXT R2, R2;      # convert B to float
FMUL32I R3, R0, 4.8015882;          # G =      R * 4.8015882 :
                                    (0.299 * 16.0 * 4095/4080)
FMAD32I R3, R1, 9.4265294, R3;      # G = G + G * 9.4265294 :
                                    (0.587 * 16.0 * 4095/4080)
FMAD32I R3, R2, 1.8307059, R3;      # G = G + B * 1.8307059 :
                                    (0.114 * 16.0 * 4095/4080)
```

At 330, one or more instances (i.e., data words) of the second-formatted pixel data is assembled into a transport packet 125, the assembled transport packet 125 having a bit width in accordance with an input bit width standard of the digital video interface. In an exemplary embodiment of this operation, two instances of the 12-bit grayscale data are assembled into one 24-bit data packet. This operation may be carried out using the described conversion shader module 120 in accordance with the following instruction set:

```
F2I.U32.F32.ROUND R0, R4;    # convert float to int 32 with rounding
F2I.U32.F32.ROUND R1, R1;    # convert float to int 32 with rounding
LOP32I.AND R2, R0, 0xF;      # copy lo nibble of G0
LOP32I.AND R3, R1, 0xF;      # copy lo nibble of G1
SHL.U32 R3,R3, 0x4;          # shift lo nibble of G1 up 1 nibble
LOP.OR.U32 R2, R2, R3;       # combine nibbles
SHR.U32 R0,R0, 0x4;          # remove nibble from G0
SHR.U32 R1,R1, 0x4;          # remove nibble from G1
```

Exemplary embodiments of the invention may include optional operations 340 and 350, in which the assembled transport packets are stored into a memory, and subsequently read out to the digital video interface. In particular embodiments of these operations, processor 211 and memory interface 213 are employed to write the assembled transport packets to the memory 212, and the memory interface 213 and the scan out processor 216 are used to read the assembled transport packets out of memory to the DVI link 140.

As readily appreciated by those skilled in the art, the described processes may be implemented in hardware, software, firmware or a combination of these implementations as appropriate. In addition, some or all of the described processes may be implemented as computer readable instruction code (or instruction set) resident on a computer readable medium, the instruction code operable to program a computer of other such programmable device to carry out the intended functions. The computer readable medium on which the instruction code resides may take various forms, for example, a removable disk, volatile or non-volatile memory, etc., or a carrier signal which has been impressed with a modulating signal, the modulating signal corresponding to instructions for carrying out the described operations.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A method, comprising:

receiving pixel data having a first format;

converting the pixel data from the first format to a second format, wherein the second-formatted pixel data is readable by a rendering device, and wherein the second-formatted pixel data comprises a bit width that differs from an input bit width standard of a digital video interface; and assembling the second-formatted pixel data into a transport packet having a bit width which is equal to the input bit width standard of the digital video interface, the digital video interface operable to receive the transport packet comprising the second-formatted pixel data, and to communicate the second-formatted pixel data to the rendering device;

wherein the assembling comprises combining a plurality of instances of the second-formatted pixel data to form the transport packet, and wherein the collective plurality of the second-formatted pixel data forms a bit width which is equal to the input bit width standard of the digital video interface.

2. The method of claim 1, wherein receiving comprises communicating pixel data from a data source to a conversion shader module without traversing an intervening program interface.

3. The method of claim 1, further comprising:

storing the transport packet into a memory; and reading the transport packet out of the memory to the digital video interface.

4. The method of claim 1, wherein the first-formatted pixel data comprises 8-bit RGB pixel data, wherein the second-formatted pixel data comprises 12-bit grayscale pixel data, wherein the input bit width standard is 24-bits, and wherein the transport packet comprises two instances of the 12-bit grayscale data.

5. The method of claim 1, wherein the first and second formats of the pixel data differ in at least one of their respective color spaces, and their respective bit lengths.

6. A method, comprising:

receiving pixel data having a first format;

converting the pixel data from the first format to a second format, wherein the second-formatted pixel data is readable by a rendering device, and wherein the second-formatted pixel data comprises a bit width that differs from an input bit width standard of a digital video interface;

assembling the second-formatted pixel data into a transport packet having a bit width which is equal to the input bit width standard of the digital video interface, the digital video interface operable to receive the transport packet comprising the second-formatted pixel data, and to communicate the second-formatted pixel data to the rendering device;

storing the transport packet into a memory; and reading the transport packet out of the memory to the digital video interface;

wherein the assembling comprises combining a plurality of instances of the second-formatted pixel data to form the trans ticket and wherein the collective plurality of the second-formatted pixel data forms a bit width which is equal to the input bit width standard of the digital video interface.

7. The method of claim 6, wherein receiving comprises communicating pixel data from a data source to a conversion shader module without traversing an intervening program interface.

8. The method of claim 6, wherein the first and second formats of the pixel data differ in at least one of their respective color spaces, and their respective hit lengths, and wherein the second-formatted pixel data does not have a bit width of 24-bits.

9. A computer program product, resident on a non-transitory computer readable medium, the computer program product comprising:

instruction set to receive pixel data having a first format;

instruction set to convert the pixel data from the first format to a second format wherein the second-formatted pixel data is readable by a rendering device, and wherein the second-formatted pixel data comprises a bit width that differs from an input bit width standard of a digital video interface; and instruction set to assemble the second-formatted pixel data into a transport packet having a bit width which is equal to the input bit width standard of the digital video interface, the digital video interface operable to receive the transport packet comprising the second-formatted pixel data, and to communicate the second-formatted pixel data to the rendering device;

wherein the instruction set to assemble comprises an instruction set to combine a plurality of instances of the second-formatted pixel data to form the transport packet, and wherein the collective plurality of the second-formatted pixel data forms a bit width which is equal to the input bit width standard of the digital video interface.

10. The computer program product of claim 9, further comprising:

instruction set to store the transport packet into a memory; and instruction set to read the transport packet out of the memory to the digital video interface.

11. The computer program product of claim 9, wherein the first and second formats of the pixel data differ in at least one of their respective color spaces, and their respective bit lengths.

12. The computer program product of claim 9, wherein the instruction set to receive comprises an instruction set to communicate pixel data from a data source to a conversion shader module without traversing an intervening program interface.

13. A graphics subsystem, comprising:

a conversion shader module configured to receive a pixel data having a first format, convert the pixel data from the first format to a second format, and assemble the second-formatted pixel data into a transport packet, wherein the second-formatted pixel data is readable by a rendering device and comprises a bit width that differs from an input bit width standard of a digital video interface, and wherein the bit width of the assembled transport packet is equal to the input bit width standard of the digital video interface; and a memory configured to store the transport packet comprising the second-formatted pixel data;

wherein the graphics subsystem is operable such that the digital video interface receives the transport packet comprising the second-formatted pixel data, and communicates the second-formatted pixel data to the rendering device;

wherein the assembling of the second-formatted pixel data into the transport packet comprises combining a plurality of instances of the second-formatted pixel data to form the transport packet, and wherein the collective plurality of the second-formatted pixel data forms a bit width which is equal to the input bit width standard of the digital video interface.

14. The graphics subsystem of claim 13, wherein the conversion shader module is connected to a data source supplying the pixel data, whereby the connection between the data source and the conversion shader module excludes an intervening program interface.

15. A graphics display system, comprising:

a data source operable to a generate pixel data having a first format;

a conversion shader module connected to the data source and configured to receive the first-formatted pixel data, convert the first-formatted pixel data to a second format, and assemble the second-formatted pixel data into a transport packet, wherein the second-formatted pixel data is readable by a rendering device and comprises a bit width that differs from an input bit width standard of a digital video interface, and wherein the bit width of the assembled transport packet is equal to the input bit width standard of the digital video interface; and a memory configured to store the transport packet comprising the second-formatted pixel data;

wherein the transport packet is read out of the memory and input to the digital video interface, the digital video interface operable to transmit the second-formatted pixel data to the rendering device;

wherein the graphics display system is operable such that the assembling of the second-formatted pixel data into the transport packet comprises combining a plurality of instances of the second-formatted pixel data to form the transport packet, and wherein the collective plurality of the second-formatted pixel data forms a bit width which is equal to the input bit width standard of the digital video interface.

16. The graphics display system of claim 15, wherein the data source is at least one of a computer desktop, a medical imaging apparatus, a data scanning system, and an image tank, and wherein the rendering device is at least one of a monitor and a printer.

17. The graphics display system of claim 15, wherein the connection between the data source and the conversion shader module excludes an intervening program interface.

18. The method of claim 2, wherein the rendering device communicates to the conversion shader module, via a back-channel, a pixel format which the rendering device is operable to read, the pixel format indicating the second-formatted pixel data.

19. The method of claim 18, wherein the conversion shader module receives the communication of the pixel format, and in response to the communication, calls and executes a corresponding conversion shader protocol to convert the pixel data to the second-formatted pixel data identified by the rendering device.

20. The method of claim 1, wherein the first-formatted pixel data comprises 8-bit RGB pixel data, wherein the second-formatted pixel data comprises 6-bit grayscale pixel data, wherein the input bit width standard is 24-bits, and wherein the transport packet comprises four instances of the 6-bit grayscale pixel data.

21. The method of claim 1, wherein the first-formatted pixel data comprises 16-bit RGB pixel data, wherein the second-formatted pixel data comprises 8-bit RGB pixel data, wherein the input bit width standard is 24-bits, and wherein the transport packet comprises three instances of the 8-bit RGB pixel data.

* * * * *